US009726037B2

(12) United States Patent
Woollenweber

(10) Patent No.: US 9,726,037 B2
(45) Date of Patent: Aug. 8, 2017

(54) BEARING SYSTEMS FOR TURBOCHARGERS USED ON INTERNAL COMBUSTION ENGINES

(71) Applicant: William E. Woollenweber, Carlsbad, CA (US)

(72) Inventor: William E. Woollenweber, Carlsbad, CA (US)

( * ) Notice: Subject to any disclaimer, the term of this patent is extended or adjusted under 35 U.S.C. 154(b) by 577 days.

(21) Appl. No.: 13/987,713

(22) Filed: Aug. 26, 2013

(65) Prior Publication Data

US 2015/0056071 A1 Feb. 26, 2015

Related U.S. Application Data

(60) Provisional application No. 61/957,586, filed on Jul. 8, 2013.

(51) Int. Cl.
*F04D 29/10* (2006.01)
*F01D 25/12* (2006.01)

(52) U.S. Cl.
CPC ..... *F01D 25/125* (2013.01); *F05D 2220/40* (2013.01)

(58) Field of Classification Search
CPC .... F01D 25/125; F01D 25/164; F01D 25/168; F01D 15/10; F02B 37/025; F02B 37/10; F02B 39/005; F02B 39/10; F02B 39/14; F04D 25/04; F04D 29/0563; F04D 29/059; F04D 29/668; F16C 27/066; F16C 35/061; F16C 35/077; Y02T 10/144; F05D 2220/40
USPC ..... 415/230, 299; 417/407; 384/490, 492, 384/535, 901, 99; 60/608
See application file for complete search history.

(56) References Cited

U.S. PATENT DOCUMENTS 4,274,663 A * 6/1981 Becker ..... E21B 17/18 175/173
7,025,579 B2 * 4/2006 Woollenweber ..... F01D 15/10 384/490
2009/0203453 A1 * 8/2009 Heinrich ..... F16D 1/0858 464/75
2015/0233382 A1 * 8/2015 Nguyen-Schaefer . F04D 29/059 415/116

FOREIGN PATENT DOCUMENTS

DE 102011081200 A1 * 2/2013 ..... F01D 25/16

* cited by examiner

*Primary Examiner* — Phutthiwat Wongwian
*Assistant Examiner* — Kelsey Stanek
(74) *Attorney, Agent, or Firm* — Donn K. Harms

(57) ABSTRACT

A bearing system for a turbocharger rotor assembly that includes an elongated bearing carrier with anti-friction bearings on each end carried in a stationary housing. The elongated bearing carrier is supported within the housing by axially spaced elastomeric bands in grooves in the outside diameter of the bearing carrier that cooperate with grooves in the bore of the stationary housing within which the elastomeric bands are seated to carry the axial thrust of the rotor assembly in both axial directions.

5 Claims, 2 Drawing Sheets

BEARING SYSTEMS FOR TURBOCHARGERS USED ON INTERNAL COMBUSTION ENGINES

RELATED APPLICATION

This patent application claims the benefit of the filing date of U.S. provisional patent application Ser. No. 61/957,586 filed Jul. 8, 2013.

FIELD OF THE INVENTION

This invention relates to bearing systems for turbochargers used on gasoline and diesel engines that are used to power passenger cars, construction equipment, farm machinery, boats, trucks and stationary power plants.

BACKGROUND OF THE INVENTION

Bearing systems for small turbochargers have gone through years of development to overcome initial problems that impeded their achieving enough durability to become a commercial success. Turbochargers small enough to be applied to diesel truck and bus engines first appeared in the late 1940's in the U.S. The Elliott Company in Jeanette, Pa., designed and developed one of the first small models that went into limited production using conventional sleeve journal bearings that had an attached radial flange to carry rotor thrust.

Diesel engines at that time were just beginning to be turbocharged, and early turbochargers were designed to be stiff shaft machines where their maximum rotational speed was below the first critical speed of the rotating assembly. As diesel engines were improved structurally to allow higher power output ratings, it became necessary to develop small turbochargers that were capable of providing higher charge air pressure.

As the maximum rotational speed of the turbochargers was increased, the power losses in the stationary sleeve bearings became excessive and bearing and shaft diameters needed to be reduced. This led to the design of flexible shaft machines where the maximum rotational speed of the turbocharger rotor exceeded the first critical speed of the rotor assembly. Since the rotor assemblies then had to run through their first critical speed, bearing systems needed to be devised that would damp the amplitude of resonant vibration of the rotor assembly as it passed through its first critical speed.

In the course of bearing system development, a phenomenon termed "shaft whirl", or "oil-film whirl", appeared in certain bearing system designs that caused unsatisfactory performance and early bearing failures occurred. This "shaft-whirl" phenomenon is described in "Mechanical Vibrations" by Den Hartog, $2^{nd}$ edition, published in 1940 by McGraw Hill. To fully investigate this phenomenon, a set of electronic equipment was invented in the late 1950's, consisting of magnetic proximity pickups mounted close to an extension of the rotor shaft that were capable of measuring the amplitude of shaft orbiting as the turbocharger was operated through its entire speed range. The results of the use of this equipment is illustrated in U.S. Pat. No. 3,056,634, where FIG. 8 shows turbocharger shaft orbiting patterns up to a speed of 78,000 RPM where the phenomenon of "shaft whirl" occurred. In FIG. 9 of the cited patent, shaft-orbiting patterns are illustrated wherein very stable operation of the turbocharger rotor was achieved by the use of a unique bearing system that suppressed the excessive orbital motion of the sleeve bearing design.

Subsequently designed bearing systems that damped the amplitude of resonant vibrations and suppressed the phenomenon of "oil whirl" are shown in U.S. Pat. No. 3,096,126 and U.S. Pat. No. 3,390,926. Both of these patents show successful bearing systems that have been used extensively in commercial turbochargers. The underlying principle leading to this success of these systems is the use of floating sleeve bearings that have an inner and outer oil film, and the bearing is allowed to rotate at a fraction of the speed of the shaft. The rotation of the bearings reduces the bearing friction loss and the inner and outer oil films allow the rotor assembly of the turbocharger to find and rotate about its center of mass. The two oil films provide sufficient damping to limit the amplitude of resonant vibrations of the rotor as it passes through its first critical speed.

The sleeve bearing systems described thus far need a separate stationary thrust bearing to carry the axial thrust loads of the turbocharger rotating assembly. A collar is provided on the shaft to bear against a stationary thrust bearing, and the high rotational speed of the collar relative to the stationary thrust bearing results in a high friction loss which, in addition to the friction losses in the sleeve bearings, results in a substantial total friction loss for the complete bearing system. This bearing system friction loss is a detriment to rapid acceleration of the turbocharger rotor.

Since it is highly advisable to have a bearing system that has a very high mechanical efficiency, an extensive effort has been expended to design and develop systems that can take advantage of the low friction losses in anti-friction or ball bearings. This effort has been recently successful, as illustrated in U.S. Pat. No. 7,677,041 B2, where angular contact ball bearings are mounted in a rotatable carrier and allow very rapid acceleration of the turbocharger rotor due to extremely low friction losses. This system is now being successfully used in commercial turbochargers.

The ball bearing system referred to above requires a supply of pressurized lubricating oil taken from the engine lube oil system. The use of lube oil in turbochargers has given rise to a number of problems over the years. Piston ring seals are used in commercial turbochargers to prevent oil leakage into the compressor casing and turbine casing. These seals are not of the positive type and a slight amount of oil can leak past the small clearance around the piston rings during certain engine operating conditions, i.e. at low idle speed. Oil leakage into the compressor casing gets carried into the engine air intake system and gets burned with the fuel in the engine cylinders, contributing to increased exhaust emissions. Oil leakage into the turbine casing mixes with the exhaust gas, also causing an increase in exhaust emissions.

In cold weather, there can be a significant time lag before viscous lube oil reaches the turbocharger bearings when the engine is started. In extreme cold weather, this time lag can cause bearing failure due to lack of oil.

Also, a hot shutdown of an engine after being operated at full load can cause residual oil in the bearing system to carbonize. Repeated hot shutdowns of an engine can eventually cause turbocharger bearings to fail due to hard carbon build-up in the bearing housing. In addition, there are limitations to where and how the turbocharger is mounted on the engine due to the necessity of providing gravity drainage of the lube oil from the bearing housing back to the engine crankcase. The cost of lube oil piping to and from the turbocharger is another consideration.

All the above-named problems associated with lube oil in turbochargers are eliminated by devising a bearing system that does not use an oil supply from the engine on which it is mounted. U.S. Pat. No. 7,025,579 B2 discloses a bearing system that uses no lube oil and is currently in commercial production. The invention described herein is also an oil-less bearing system and represents a significant improvement over the bearing system shown in U.S. Pat. No. 7,025,579 B2.

The turbocharger bearing system illustrated in U.S. Pat. No. 7,025,579 B2 uses grease-lubricated ball bearings mounted in a cylindrical bearing carrier which is carried by "O" rings between the bearing housing bore and the outside diameter of the bearing carrier. The "O" rings prevent rotation of the bearing carrier but still allow the rotor assembly of the turbocharger to find and rotate about its center of mass. The cylindrical bearing carrier is provided with a radially extending flange on one end to carry rotor thrust transmitted through the angular contact bearings to the stationary housing members. This flange must be supplied with a lubricating fluid to prevent wear and fretting of the mating surfaces of the flange and stationary housing members on which it bears to carry thrust.

As shown in U.S. Pat. No. 7,025,579 B2, a cooling jacket is provided in the bearing housing fed by liquid coolant from the engine cooling system. The outside diameter of the cylindrical bearing carrier is exposed to the coolant over a portion of its length to carry away heat generated in the bearings. This bearing system eliminates all the problems and cost associated with lubricating oil being introduced into the turbocharger bearing housing and, subsequently, carried back to the engine crank case. Another advantage of a bearing system that does not use oil is complete flexibility as to where and how the turbocharger can be mounted on the engine.

The invention described herein represents a significant improvement over the bearing system described in U.S. Pat. No. 7,025,579 B2 by providing a means of eliminating the radially extending flange on the end of the bearing carrier and eliminating the corresponding mating thrust faces on the stationary housing parts, thus significantly reducing the cost of the system.

BRIEF SUMMARY OF THE INVENTION

This invention provides bearing systems for turbochargers used on internal combustion engines that can provide extremely low friction losses through the use of anti-friction ball bearings with ceramic balls that do not require a supply of lubricating oil from the engine on which they are mounted.

This invention uses elastomeric bands or "O" rings seated in grooves near the ends of the outside diameter of an elongated cylindrical bearing carrier. The outside diameter of the bearing carrier in between the "O" rings cooperates with the housing that carries it to form a cooling jacket for handling coolant flow to and from the housing. The "O" rings in the O.D. of the bearing carrier, when assembled, are compressed into corresponding grooves in the bore of the bearing housing, thus sealing the cooling jacket and provide a means of carrying the thrust loads generated by the turbocharger rotor, transmitted from the rotor through the bearings mounted in the bearing carrier. The "O" rings that support the bearing system allow the rotating assembly to find and rotate about its mass center and dampen any shock and vibration loads carried to the turbocharger from outside sources.

A preferred embodiment of the invention comprises a deep groove ball bearing in one end of an elongated cylinder that has the ability to carry axial thrust loads in both axial directions. An angular contact ball bearing is slidably mounted in the opposite end of the elongated cylinder, enabling it to move axially when the shaft expands axially from heat conducted to it from the hot turbocharger turbine wheel.

The elongated cylinder carries two elastomeric members, such as "O" rings, spaced apart in circumferential grooves near each end that, when assembled in the bearing housing, seat in corresponding grooves in the bearing housing bore. Thus seated, the "O" rings are capable of carrying axial thrust in both directions as well as allowing the rotating assembly to find and rotate about its center of mass. The elastomeric members can be made of a high temperature resistant rubber, such as Viton.

The bearing housing of the turbocharger is provided with an annular cooling media jacket that surrounds the elongated cylinder so the outside diameter of the elongated cylinder in between the "O" rings forms the inner boundary of the cooling media jacket. This arrangement allows the cooling media to flow over the middle portion of the elongated cylinder, carrying away the heat generated in the ball bearings while, at the same time, cools the elastomeric members. The cooling media can be either engine coolant or compressed air bled from the engine intake manifold. In this invention, the elastomeric members act as seals and also as radial springs that allow minor orbital excursions of the elongated cylinder that occur due to residual unbalance in the rotating assembly.

This preferred embodiment of the invention does not require a supply of pressurized oil from the internal combustion engine since the ball bearings are lubricated with a high temperature resistant grease. Also, the elongated cylinder does not need a radially extending flange on one end to carry rotor thrust to the stationary housing surfaces, since the "O" rings carry the rotor thrust in both directions.

A minor variation of the preferred embodiment of this invention is one where the deep groove ball bearing on one end of the elongated cylinder is replaced by back-to-back angular contact ball bearings that are able to carry the rotor thrust in both directions. These angular contact ball bearings can be of the full compliment type with ceramic balls and be identical with the angular contact ball bearing that is slidably mounted in the opposite end of the elongated cylinder. Full compliment bearings do not need a cage to space the balls, thus enabling them to reach high operating speeds, especially when provided with ceramic balls.

This invention provides turbocharger bearing systems that exhibit minimal friction losses, allowing very rapid acceleration of the turbocharger rotor and corresponding rapid acceleration of the vehicle in which the engine is mounted. Both embodiments eliminate the use of a lube oil supply from the engine.

Both embodiments eliminate a radially extending thrust flange from the elongated cylinder and the corresponding mating surfaces in the stationary housing, resulting in a significantly lower manufacturing cost.

MORE DETAILED DESCRIPTION OF THE INVENTION

The bearing system of this invention is adapted to support, within stationary elements of a turbocharger, a high-speed rotating assembly.

Figure 1:
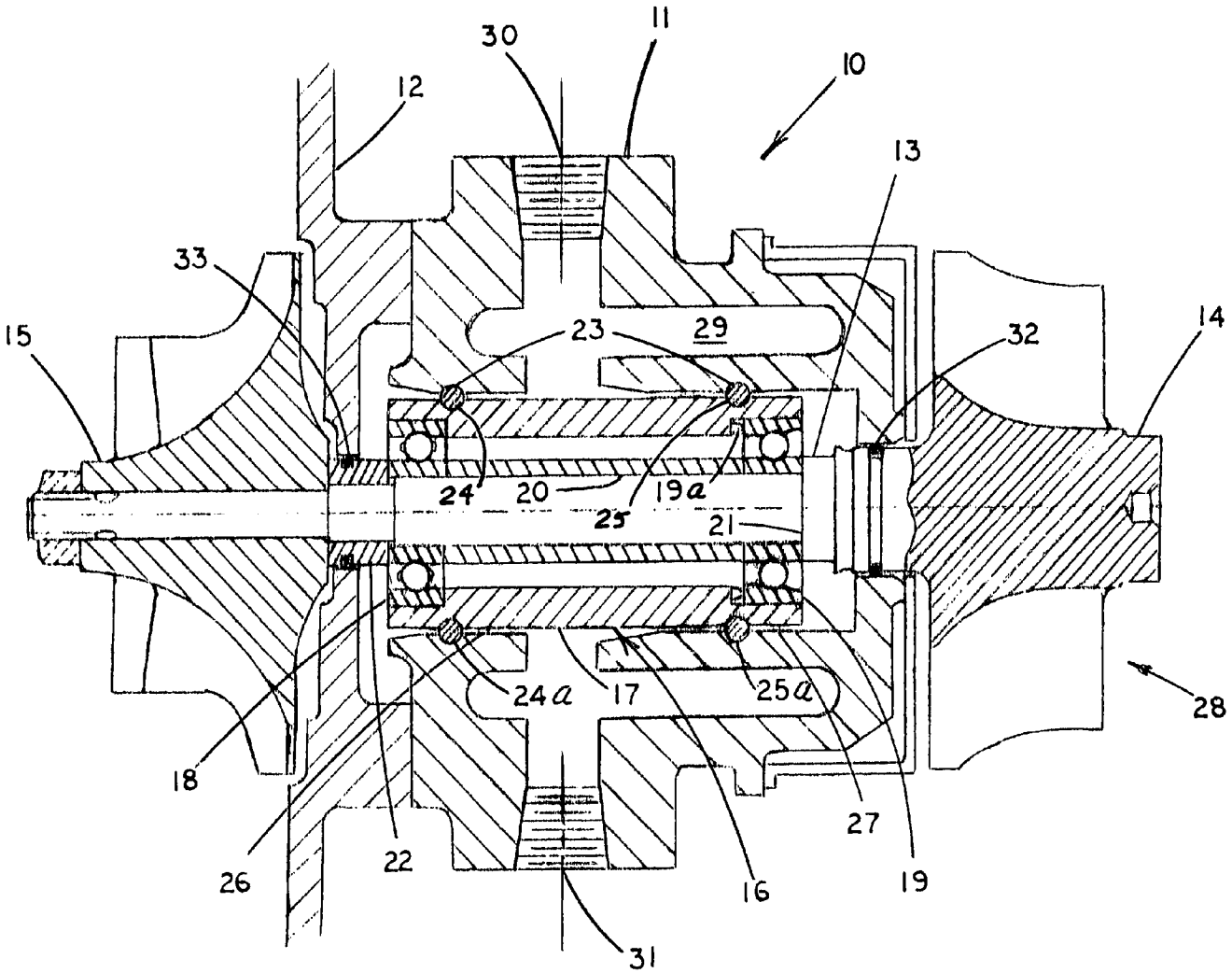
FIG. 1 is a cross-sectional view taken along a plane through the axis of rotation of a turbocharger, utilizing a grease-lubricated ball bearing version of this invention.

As set forth above, FIG. 1 illustrates the center section of a turbocharger 10, wherein stationary elements, such as bearing housing 11 and end housing 12, enclose a rotating shaft 13, a turbine wheel 14 at one end and a compressor wheel 15 at the other end. The bearing system 16 of the invention carries the rotating shaft 13 and is carried by the bearing housing 11. As is well known in the art, the rotor assemblies of the turbochargers can attain speed up to 200,000 RPM and are exposed to very high temperatures of engine exhaust gas at their turbine ends.

The bearing system 16 of this invention, which is illustrated in FIG. 1, comprises an elongated cylinder 17 with a deep groove ball bearing 18 at its compressor end, capable of carrying rotor thrust in both axial directions, and an angular contact ball bearing 19 slidably mounted at its turbine end. In one embodiment of this invention, the angular contact ball bearing 19 comprises a full compliment of ceramic balls and is mounted against a pre-load spring 19*a* slidably in its bore. This allows it to move axially when the shaft 13 expands axially due to heat conducted to it from the hot turbine wheel 14.

The inner races of both ball bearings 18 and 19 are separated by spacer 20 and are clamped between the shaft shoulder 21 and sleeve 22 and rotate with shaft 13.

As illustrated in FIG. 1, the elongated cylinder 17 is supported within the bearing housing 11 by a plurality of elastic supports which are preferably elastomeric bands 23, seated in grooves 24 and 25 in the outside surface of the elongated cylinder 17. When assembled, the elastomeric bands 23 are compressed into corresponding grooves 24*a* and 25*a*, in the bearing housing bores 26 and 27, the elastomeric bands 23 serve to position the bearing system 16 and rotor assembly 28 axially within the bearing housing 11. They also carry the thrust load of the rotor, transmitted through the ball bearings 18 and 19, to the grooves 24*a*, 25*a* in the bearing housing 11. The elastomeric bands 23 also act as radial springs that allow minor orbital motion of the bearing system 16 that may result from any residual unbalance in the turbocharger rotating assembly 28, and they also cushion the rotating assembly 28 from shock and vibration.

As illustrated in FIG. 1, the bearing housing 11 includes a coolant cavity 29 for engine coolant to carry away heat transferred to the bearing assembly 16 from the hot parts of the turbocharger. The inner boundary of the coolant cavity is formed by the outside diameter of the elongated cylinder 17. The coolant cavity 29 has an inlet 30 that may be connected to the cooling system of an engine and an outlet 31 that carries the coolant from the coolant jacket 29 and returns it to the cooling system of the engine.

Coolant is allowed to circulate around the outside diameter of the elongated cylinder 17 and carries away heat generated in the ball bearings 18 and 19. The elastomeric bands 23 seal the portion of the outside diameter of the elongated cylinder 17 that forms the boundary of the cooling jacket cavity 29 in the bearing housing 11. The elastomeric bands 23 are preferably of a high-temperature rubber, such as Viton, and may be Viton "O" rings. A piston ring seal 32 prevents hot exhaust gas from entering the bearing system cavity and a second piston ring seal 33 prevents compressed air from entering the bearing system cavity.

As illustrated in FIG. 1, the deep groove ball bearing 18, mounted in the compressor end of the elongated cylinder 17, carries the rotor axial thrust load in both axial directions.

Figure 2:
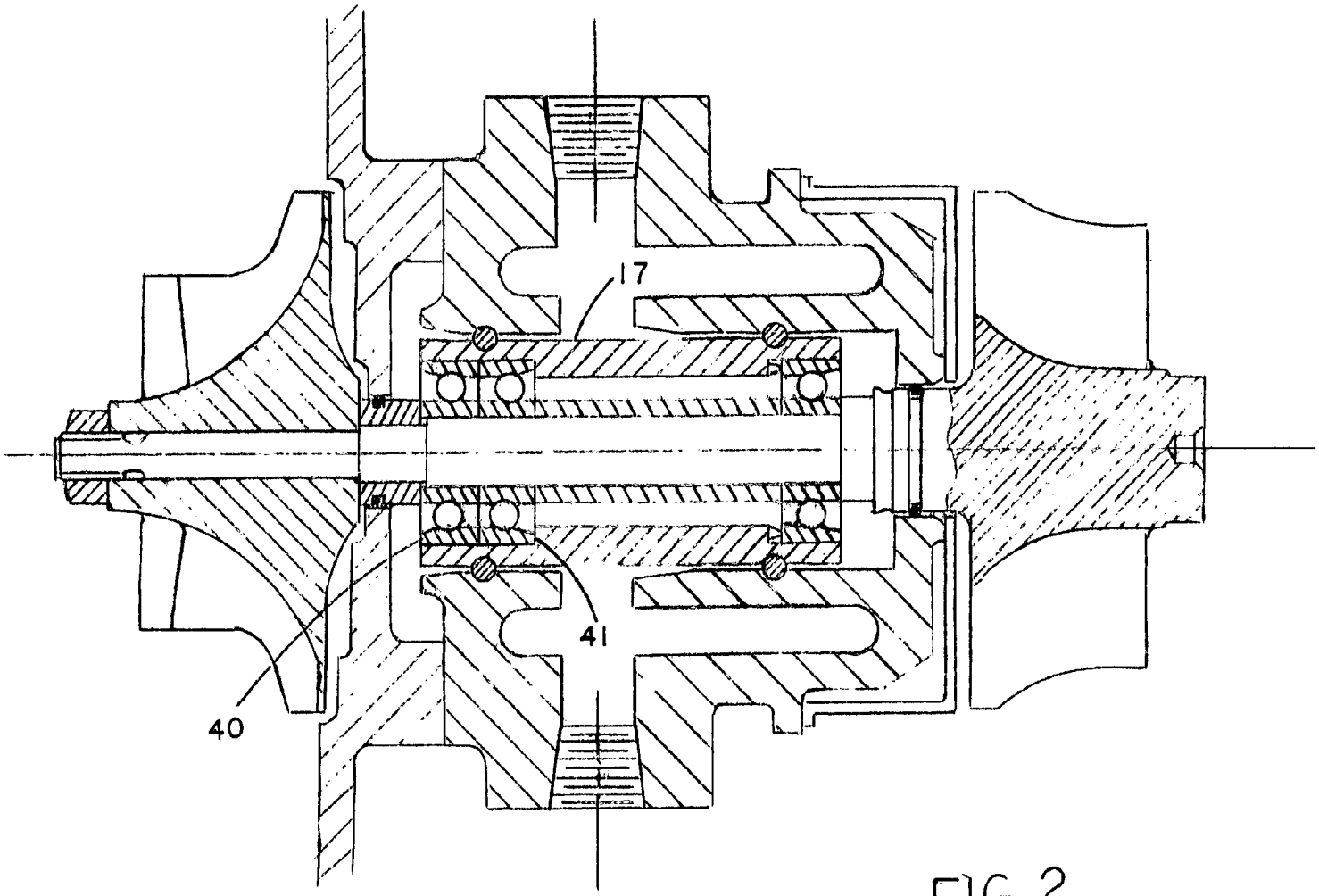
FIG. 2 is a cross-sectional view taken along a plane through the axis of rotation of a turbocharger, utilizing an embodiment of this invention with an alternate arrangement of grease-lubricated ball bearings.

FIG. 2 illustrates an alternate method of carrying the rotor thrust by mounting two angular contact ball bearings 40 and 41 back-to-back in the compressor end of the elongated cylinder 17 in place of the deep groove ball bearing 18 that is shown in FIG. 1. The back-to-back arrangements of the angular contact bearings 40 and 41 allows bearing 40 to carry axial thrust toward the turbine end and bearing 41 to carry axial thrust toward the compressor end. Since the full compliment angular contact bearings 40 and 41 do not have a cage to position the balls, they are able to reach higher operating speeds than the deep groove ball bearing 18 that must use a cage to position the balls.

The invention illustrated and described herein provides a less complicated turbocharger structure and provides an internal combustion engine turbocharger capable of at least equal operating characteristics. Comparing the invention with the prior art U.S. Pat. No. 7,025,579 82, a turbocharger of the invention eliminates the prior art radially-extending flange 31*d* of the bearing carrier 31 and its thrust-carrying faces 31*e* and 31*f*, their anti-friction coatings and their mating thrust-bearing surfaces in the bearing housing 11 and end housing 16. In contrast, in the invention elastomeric bands 23 are held in grooves 24 and 25 in an bearing-carrying elongated cylinder 17 and corresponding grooves 24*a* and 25*a* of a bearing housing bore 27 within the bearing housing 11 and carry axial rotor thrust in both directions while cooperating with the bearing housing 11 to form a cooling jacket for the bearings 18, 19 and handle coolant flow to and from the bearing housing 11. They also allow the entire rotating assembly of the turbocharger 10 carried by the bearing housing 11 minor orbital motion that may result from any residual unbalance in the rotating assembly.

The present invention represents a signification reduction in the complexity and manufacturing cost over prior art turbochargers, such as those shown in U.S. Pat. No. 7,025, 579 B2.

The invention claimed is:

1. A bearing system for a rotating assembly carried in a housing of a turbocharger for an internal combustion engine, wherein the bearing system and housing combine to form a coolant cavity by an elongated bearing carrier whose outer surface forms one surface defining the coolant cavity and is sealed with said housing by an elastomeric band on each end of said one surface, each said elastomeric band being seated in a groove formed into a housing bore and a peripheral groove formed into the outer surface to coincide with the groove in the housing bore to carry rotor thrust in both axial directions.

2. The bearing system of claim 1 wherein said outer surface of the elongated bearing carrier is cylindrical, and wherein each peripheral groove is a peripheral "O"-ring groove formed into said outer surface at each end of said one surface, and said elastomeric bands are "O"-rings seated in each said peripheral "O"-ring groove that are located to coincide with said grooves in said housing bore when said elongated bearing carrier is assembled to a position within said housing bore.

3. The bearing system of claim 1 wherein the elastomeric bands seated in said peripheral "O"-ring grooves and concurrently seated in said grooves in said housing bore, function to carry rotor thrust in both axial directions.

4. A turbocharger for use on internal combustion engines, comprising:

a bearing housing carrying a turbocharger rotating assembly including a rotatable shaft with a compressor wheel at one end rotatably drivable by an engine exhaust gas turbine wheel at the opposite end, said rotatable shaft being rotatably carried within a tubular bearing carrier by ball bearings adjacent opposite ends of the tubular bearing carrier, said ball bearings being adapted to carry thrust forces in both axial directions to the tubular bearing carrier, said tubular bearing carrier being carried within a housing bore within the bearing housing by elastomeric bands engaged with and carried by correspondingly spaced grooves formed into both the housing bore of the bearing housing and the tubular bearing carrier, whereby axial rotor thrust forces imparted to the tubular bearing carrier are carried by the elastomeric bands to the bearing housing.

5. The turbocharger of claim 4, wherein the bearing housing includes a central cooling jacket around the tubular bearing carrier connectible with a source of cooling fluid from an internal combustion engine, and wherein the elastomeric bands carried by said correspondingly spaced grooves provide seals between the housing bore of the bearing housing and an outer surface of the tubular bearing carrier confining the cooling fluid adjacent the outer surface of the tubular bearing carrier.

* * * * *